US006885358B2

(12) United States Patent
Anh

(10) Patent No.: US 6,885,358 B2
(45) Date of Patent: Apr. 26, 2005

(54) LCD DRIVING CIRCUIT

(75) Inventor: Kwang Soo Anh, Chungcheongbuk-do (KR)

(73) Assignee: Hynix Semiconductor Inc., Ichon-shi (KR)

( * ) Notice: Subject to any disclaimer, the term of this patent is extended or adjusted under 35 U.S.C. 154(b) by 234 days.

(21) Appl. No.: 10/011,809

(22) Filed: Dec. 11, 2001

(65) Prior Publication Data

US 2002/0089498 A1 Jul. 11, 2002

(30) Foreign Application Priority Data

Jan. 6, 2001 (KR) ..... 2001-729

(51) Int. Cl.[7] ..... G09G 3/36
(52) U.S. Cl. ..... 345/98; 345/96; 345/100
(58) Field of Search ..... 345/87, 94, 96, 345/98, 100, 209

(56) References Cited

U.S. PATENT DOCUMENTS 5,280,279 A * 1/1994 Nakazawa et al. ..... 345/38
5,754,156 A 5/1998 Erhart et al.
6,008,801 A * 12/1999 Jeong ..... 345/204
6,049,321 A * 4/2000 Sasaki ..... 345/99
6,256,005 B1 * 7/2001 Kim ..... 345/88

* cited by examiner

*Primary Examiner*—Dennis-Doon Chow
(74) *Attorney, Agent, or Firm*—Mayer, Brown, Rowe & Maw LLP

(57) ABSTRACT

LCD driving circuit for applying a signal of a first polarity and a signal of a second polarity opposite to the first polarity to an LCD alternately, including first and second data latches for latching source data in succession, a DAC for converting a latch data into an analog signal to provide a signal of the first polarity, a driving signal processing block for receiving a converted signal from the DAC to provide a signal of the second polarity, a multiplexer for selecting either one of signals of first and second polarities in response to a polar signal, and a buffer for buffering a signal from the multiplexer and applying a source driving signal to LCD cells, thereby permitting to use only one type of DAC.

14 Claims, 3 Drawing Sheets

LCD DRIVING CIRCUIT

BACKGROUND OF THE INVENTION

1. Field of the Invention

The present invention relates to a liquid crystal device, and more particularly, to an LCD (Liquid Crystal Display) driving circuit, in which dot inversion type source driving is implemented by using one type of DAC.

2. Background of the Related Art

A related art LCD controls a light transmittivity of LCD cells on an LCD panel for displaying a picture relevant to a video signal. For driving the LCD cell on the LCD panel, one of driving systems selected from a frame inversion system, a line inversion system, and a dot inversion system is used. In the frame inversion system, a polarity of a data signal supplied to each of the LCD cells on the LCD panel is inverted every time a frame is changed. In the line inversion, a polarity of the data signal supplied to the LCD cells along gate lines, i.e, lines on the panel is inverted. In the dot inversion, data signals of polarities opposite to adjacent cells are supplied to cells both on gate lines and data lines, and polarities of the data signals supplied to all the LCD cells are inverted whenever frames are changed. In other words, the data signals are supplied to the LCD cells on the LCD panel such that a positive polarity "+" (high voltage) and a negative polarity "−" (low voltage) are displayed alternately as it goes from an LCD at left top side to LCD cells in a right direction, and low direction when video signals of an odd numbered frame is displayed. Opposite to this, the data signals are supplied to the LCD cells on the LCD panel such that a positive polarity "+" and a negative polarity "−" are displayed alternately as it goes from an LCD at left top side to LCD cells in a right direction, and low direction when video signals of an even numbered frame is displayed. Of those three LCD panel driving systems, the dot inversion system can provide a picture of an excellent picture quality as data signals of polarities opposite to the data signals supplied to adjacent LCD cells in the vertical and horizontal directions respectively can be provided to any desired LCD cells. Owing to this merit, currently, LCD driving of the dot inversion system is used mostly. There are cases when a particular pattern, such as check pattern, sub-pixel pattern, windows shutdown mode pattern, or the like is required to be displayed in the dot inversion type LCD system. In this instance, in the dot inversion type LCD panel driving system, there may be flicker on the picture displayed in the dot inversion type LCD panel driving system caused by frame inversion effect.

A related art LCD will be explained with reference to the attached drawings. FIG. 1 illustrates a driving circuit of a related art LCD. For driving the dot inversion system employed for preventing hardening of liquid crystal in the related art, both a high voltage DAC (Digital to Analog Converter) and a low voltage DAC are used, which occupy most of a driver IC area. Specifically, FIG. 1 illustrate a structure of a source driver IC suggested by Vivid Semiconductor, Inc., (U.S. Pat. No. 5,754,156). In order to reduce the DAC area, one pair of channels of the high voltage DAC and the low voltage DAC are provided, with one channel for a P decoder, and the other channel for N decoder, for driving the LCD by using both the P decoder and the N decoder once, and other type of decoder on the other channel, i.e., only one channel and one type of decoder by using a multiplexer at the next time. That is, as shown in FIG. 1, the DAC on first channel 11 is a block for converting a high voltage area, and the DAC on the second channel 12 is a block for converting a low voltage area. Thus, the pixel driving by the dot inversion system using a multiplexer can reduce DAC on channels by half.

However, the source driver in the related art LCD has the following problems.

The alternate arrangement of high voltage DAC and the low voltage DAC on each channel requires two times of reference voltages, that in turn makes to requires blocks for generating the high reference voltage and the low reference voltage respectively, thereby limiting reduction of a chip size.

SUMMARY OF THE INVENTION

Accordingly, the present invention is directed to an LCD driving circuit that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the LCD driving circuit for applying a signal of a first polarity and a signal of a second polarity opposite to the first polarity to an LCD alternately includes first and second data latches for latching source data in succession, a DAC for converting a latch data into an analog signal to provide a signal of the first polarity, a driving signal processing block for receiving a converted signal from the DAC to provide a signal of the second polarity, a multiplexer for selecting either one of signals of first and second polarities in response to a polar signal, and a buffer for buffering a signal from the multiplexer and applying a source driving signal to LCD cells.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
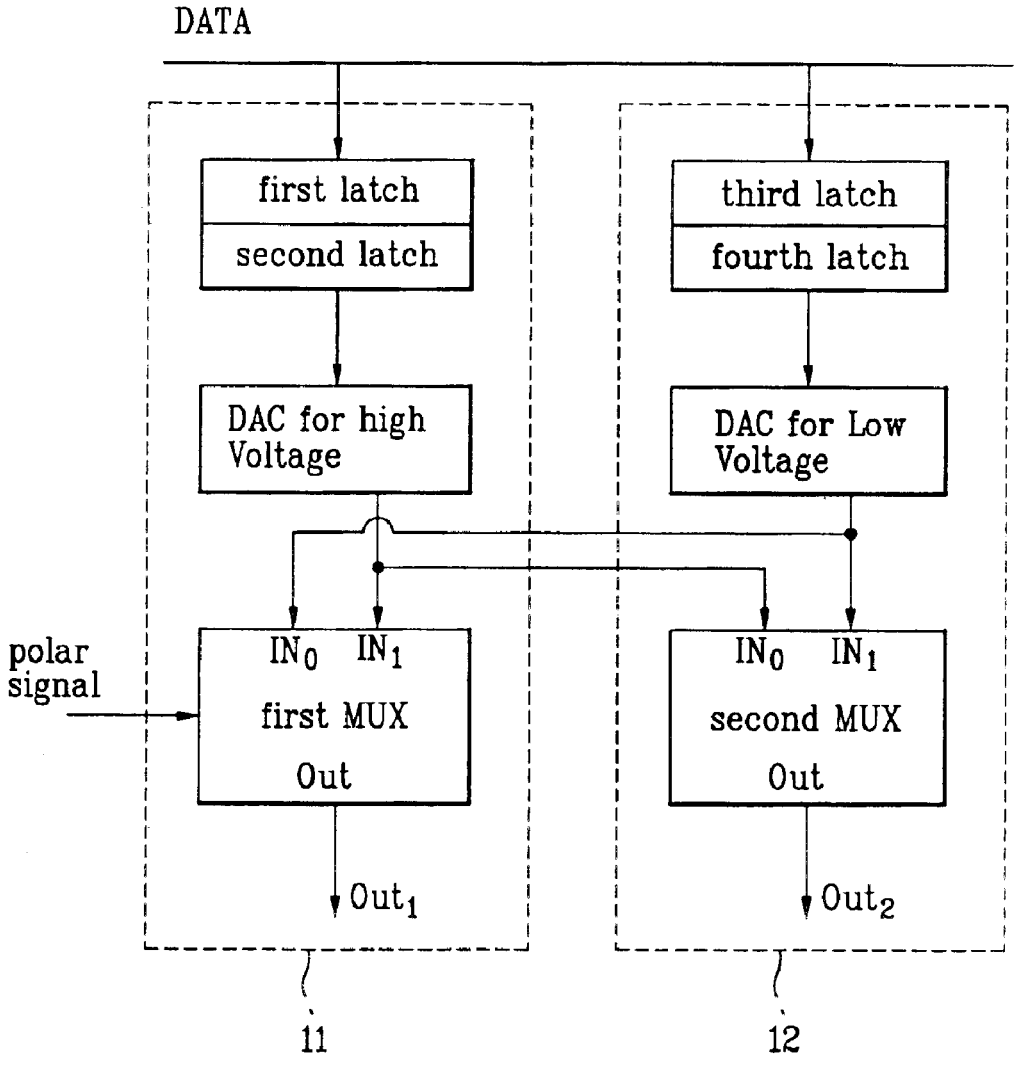
FIG. 1 Related Art
FIG. 1 illustrates a driving circuit of a related art LCD.
Figure 2:
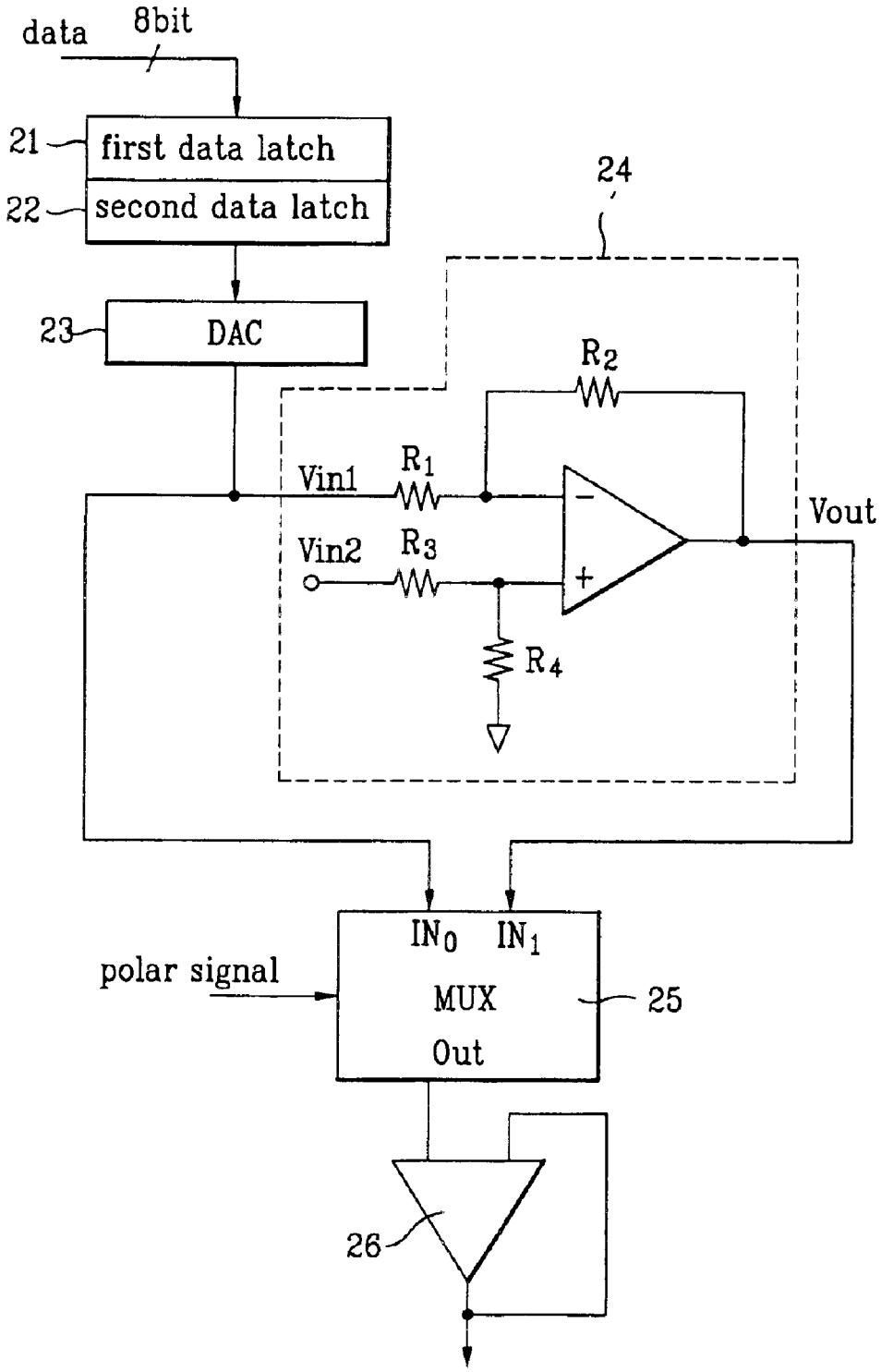
FIG. 2 illustrates a driving circuit of an LCD in accordance with a preferred embodiment of the present invention; and, FIG. 3 illustrates a graph showing a gamma curve of the LCD of the present invention.
Figure 3:
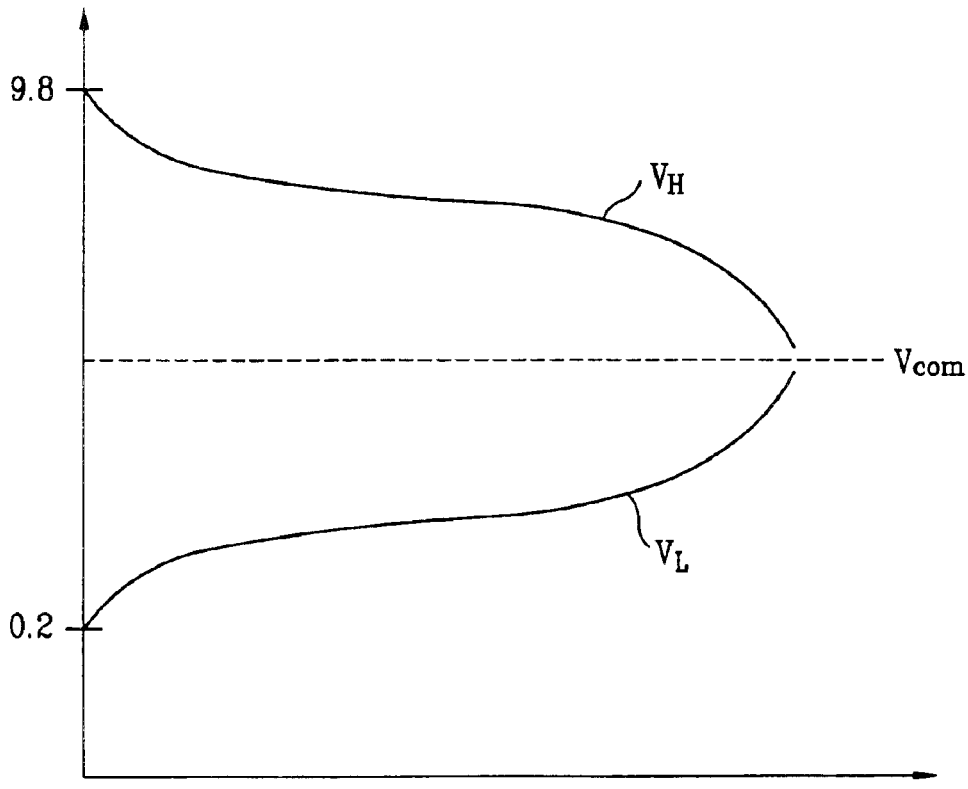

Reference will now be made in detail to the preferred embodiments of the present invention, examples of which are illustrated in the accompanying drawings. FIG. 2 illustrates a driving circuit of an LCD in accordance with a preferred embodiment of the present invention, and FIG. 3 illustrates a graph showing a gamma curve of the LCD of the present invention. The present invention suggests to provide a driving circuit of either high voltage DAC or a low voltage DAC for dot inversion type driving of an LCD.

Referring to FIG. 2, the LCD driving circuit of the present invention includes first and second data latches 21 and 22 for latching and forwarding source data in succession taking turning on times of gate lines into account, a DAC 23 for converting a signal from the second data latch 22 into an analog signal, a driving signal processing block 24 for receiving and converting a signal from the DAC 23 to provide a signal of a region opposite to a conversion region, a multiplexer 25 for receiving signals IN0 and IN1 from the DAC 23 and the driving signal processing block 24 respectively and forwarding the signals selectively in response to a polar signal, and a buffer 26 for buffering the signal selected at the multiplexer 25. In this instance, the DAC 23 may be either the high voltage DAC or the low voltage DAC, wherein, if the DAC 23 is of the high voltage DAC type, the driving signal processing block 24 serves as the low voltage DAC, and, if the DAC 23 is of the low voltage DAC type, the driving signal processing block 24 serves as the high voltage DAC.

The operation of the driving signal processing block 24 in the LCD of the present invention of which LCD cells are driven in a dot inversion system by using one DAC will be explained in detail.

The driving signal processing block 24 includes an operational amplifier having an inversion terminal for receiving a signal Vin1 from the DAC 23 through a resistor R1 and a non-inversion terminal for receiving a voltage Vibn2, for providing a conversion signal value Vout of a region opposite to a conversion region of the DAC 23. The signal Vout from the operational amplifier is fed back to the inversion terminal through a resistor R2, and there is a resistor R4 connected to a node between the resistor R3 and the non-inversion terminal and a ground terminal. The signal Vout from the driving signal processing block can be defined as follows.

$$Vout=-(R2/R1)Vin1+((1+R2/R1)/(1+R3/R4))Vin2.$$

When the equation is modified with respect to (R2/R1)=(R4/R3), Vout=(R2/R1)(Vin2−Vin1) is obtained. If R2/R1=1, what we obtain is Vout=Vin2−Vin1.

The operation of the driving signal processing block of the present invention will be explained with reference to the above equations.

For an example, if Vin2 is 10V, Vout=10−Vin1, if the source driver IC has a 0.2~9.8V dynamic output range, a gamma curve can be as shown in FIG. 3, wherein as $V_H+V_L=10V$, $V_L=10-V_H$. Therefore, if the DAC 23 is of the high voltage type, the signal from the DAC 23 is the $V_H$ signal, and the signal from the driving signal processing block 24 is the $V_L$ signal. If the DAC 23 is of the low voltage type, the signal from the DAC 23 is the $V_L$ signal, and the signal from the driving signal processing block 24 is the $V_H$ signal. Thus, by forwarding the Vin1 and Vout signals selectively at the multiplexer 25 according to a polar signal, LCD cells can be driven in a dot inversion system.

As has been explained, the LCD driving circuit of the present invention has the following advantages.

Only one of two channels (a high region or a low region) required for dot inversion is provided with a DAC for facilitating two channel driving, that permits to reduce a chip size since the reference voltage generating block and DAC are provided only to one side channel. That is, as one of two decoder blocks can be dispensed with, the chip size can be reduced by approx. 30%.

It will be apparent to those skilled in the art that various modifications and variations can be made in the LCD driving circuit of the present invention without departing from the spirit or scope of the invention. Thus, it is intended that the present invention cover the modifications and variations of this invention provided they come within the scope of the appended claims and their equivalents.

What is claimed is:

1. An LCD (Liquid Crystal Display) driving circuit for applying a signal of a first polarity and a signal of a second polarity opposite to the first polarity to an LCD alternately, comprising:

first and second data latches for latching source data in succession;

a DAC for converting a latch data into an analog signal to provide a signal of the first polarity;

a driving signal processing block for receiving a converted signal from the DAC to provide a signal of the second polarity;

a multiplexer for selecting either one of the signal of the first polarity from the DAC and the signal of the second polarity from the driving signal processing block in response to a polar signal; and a buffer for buffering a signal from the multiplexer and applying a source driving signal to LCD cells.

2. An LCD driving circuit as claimed in claim 1, wherein the polar signal is applied such that the signals of the first and second polarities are provided, alternately.

3. An LCD driving circuit as claimed in claim 1, wherein the driving signal processing block provides a low voltage value if the DAC is of a high voltage type and the driving signal processing block provides a high voltage value if the DAC is of a low voltage type.

4. An LCD driving circuit as claimed in claim 1, wherein the driving signal processing block includes an operational amplifier having an inversion terminal for receiving a signal Vin1 from the DAC through a resistor R1 and a non-inversion terminal for receiving a voltage Vin2, for providing a conversion signal value Vout of a region opposite to a conversion region of the DAC, wherein the signal Vout from the operational amplifier is fed back to the inversion terminal through a resistor R2, and there is a resistor R4 connected to a node between the resistor R3 and the non-inversion terminal and a ground terminal.

5. An LCD driving circuit as claimed in claim 4, wherein the signal Vout from the driving signal processing block is Vout=Vin2−Vin1.

6. An LCD (Liquid Crystal Display) driving circuit for applying a signal of a first polarity and a signal of a second polarity opposite to the first polarity to an LCD alternately, comprising:

first and second data latches for latching source data in succession;

a DAC for converting a latch data into an analog signal to provide a signal of the first polarity;

a driving signal processing block for receiving a converted signal from the DAC to provide a signal of the second polarity;

a multiplexer for selecting either one of signals of first and second polarities in response to a polar signal; and a buffer for buffering a signal from the multiplexer and applying a source driving signal to LCD cells;

said driving signal processing block including an operational amplifier having an inversion terminal for receiving a signal Vin1 from the DAC and a non-inversion terminal for receiving voltage Vin2, for providing a conversion signal Vout of a region opposite to a conversion region of the DAC.

7. An LCD driving circuit as claimed in claim 6, wherein the polar signal is applied such that the signals of the first and second polarities are provided, alternately.

8. An LCD driving circuit as claimed in claim 6, wherein the driving signal processing block provides a low voltage value if the DAC is of a high voltage type and the driving signal processing block provides a high voltage value if the DAC is of a low voltage type.

9. An LCD driving circuit as claimed in claim 6, wherein the signal Vout from the driving signal processing block is Vout=Vin2−Vin1.

10. An LCD driving circuit as claimed in claim 6, wherein said inversion terminal receives the signal Vin1 from the DAC through a first resistor, and the non-inversion terminal receives the voltage Vin2 through a second resistor.

11. An LCD driving circuit as claimed in claim 10, wherein the signal Vout from the operational amplifier is fed back to the inversion terminal through a third resistor, and there is a fourth resistor connected to a node between the second resistor and the non-inversion terminal and a ground terminal.

12. An LCD driving circuit as claimed in claim 11, wherein the polar signal is applied such that the signals of the first and second polarities are provided, alternately.

13. An LCD driving circuit as claimed in claim 11, wherein the driving signal processing block provides a low voltage value if the DAC is of a high voltage type and the driving signal processing block provides a high voltage value if the DAC is of a low voltage type.

14. An LCD driving circuit as claimed in claim 11, wherein the signal Vout from the driving signal processing block is Vout=Vin2−Vin1.

* * * * *